US006068262A

United States Patent [19]

Goldfarb et al.

[11] Patent Number: 6,068,262

[45] Date of Patent: May 30, 2000

[54] SELECTION GAME

[75] Inventors: Adolph E. Goldfarb, Westlake Village; Martin I. Goldfarb, Santa Monica, both of Calif.

[73] Assignee: Eddy & Martin Goldfarb and Associates LLC, Northridge, Calif.

[21] Appl. No.: 09/238,109

[22] Filed: Jan. 27, 1999

Related U.S. Application Data

[63] Continuation-in-part of application No. 09/127,997, Jul. 31, 1998, Pat. No. 5,979,900, which is a continuation-in-part of application No. 08/944,079, Oct. 4, 1997, Pat. No. 5,823,538, which is a continuation-in-part of application No. 08/796,713, Feb. 6, 1997, Pat. No. 5,704,610.

[51] Int. Cl.[7] ..... A63F 9/24

[52] U.S. Cl. ..... 273/457; 273/265; 273/460; 273/255

[58] Field of Search ..... 273/445, 440, 273/455, 457, 459, 460, 265, 454, 255

[56] References Cited

U.S. PATENT DOCUMENTS

| | | | |
|---|---|---|---|
| 4,365,811 | 12/1982 | Krzes | 273/265 X |
| 5,823,538 | 10/1998 | Goldfarb et al. | 273/445 |
| 5,887,874 | 3/1999 | Goldfarb et al. | 273/455 |

*Primary Examiner*—Raleigh W. Chiu
*Attorney, Agent, or Firm*—Ashen & Lippman

[57] ABSTRACT

A game for play by one or more players. The illustrated game includes a selection surface for each player. Each surface faces a player area where the associated player would position herself to observe the surface. A liquid discharge mechanism is selectively operable to direct a liquid discharge toward the player areas. The selection surface has a plurality of sites or locations. At the start of each game, a group or some but not all of the sites on a selection surface are predetermined, but the player associated with that surface does not know which sites have been predetermined. The players may take turns selecting sites on their surfaces with the objective of selecting the predetermined sites. As one player makes selections, the discharge mechanism is directed toward the other player's play area, and when a predetermined selection is successfully selected, the opposing player may receive a liquid discharge or spray. Audio and/or visual "effects" may also accompany the selections and distinguish between hits and misses. In one illustrated form, each player also has a target surface with sites associated with the opponent's selection sites. At the start of each game each player may set up targets on her target surface, which serves to establish the predetermined sites at the opponent's selection surface. Thus, selection becomes attacking your opponent's targets. One illustrated selection probe uses simple switches to determine "hits" and may actuate a liquid discharge and/or another effect. A single player version may use only a single selection surface, with sites predetermined by a microprocessor, and the player being sprayed when she incorrectly makes a selection.

23 Claims, 5 Drawing Sheets

FIG. 2
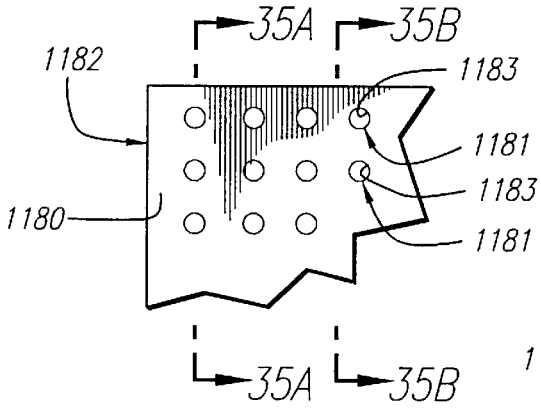
FIG. 6
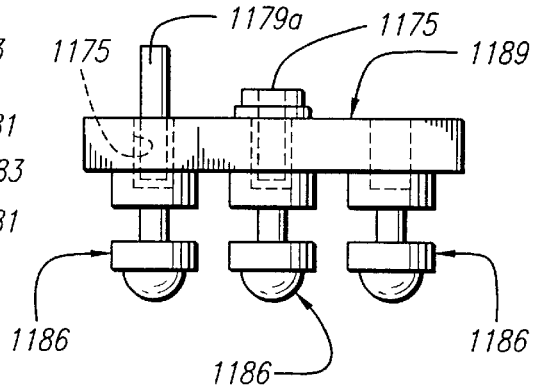
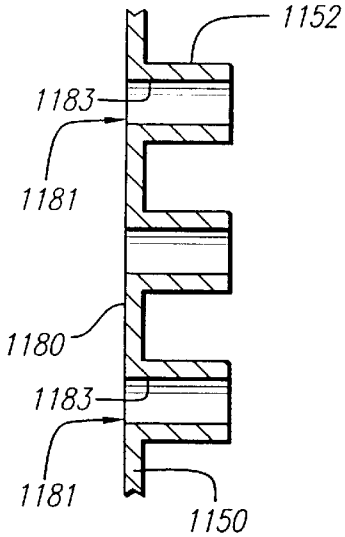
FIG. 2A
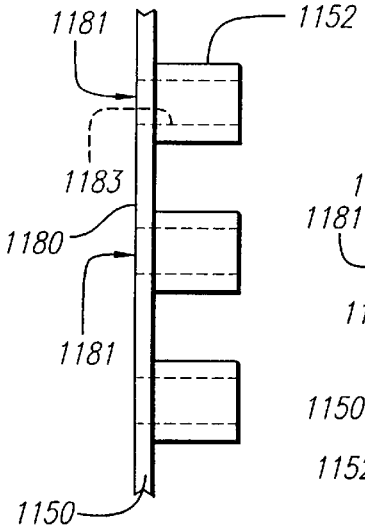
FIG. 2B
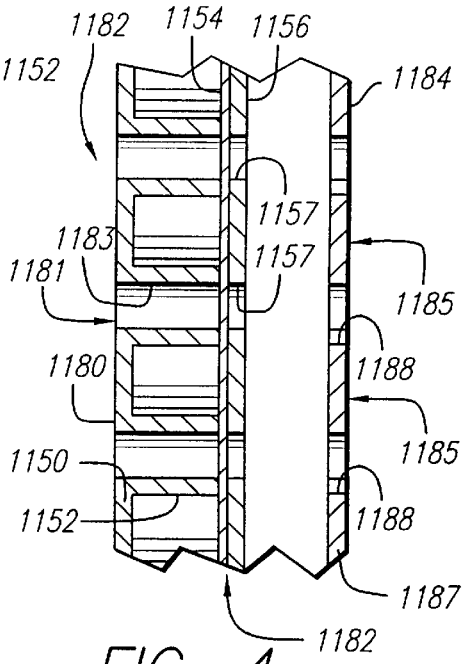
FIG. 4
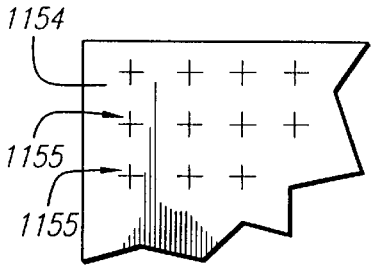
FIG. 5
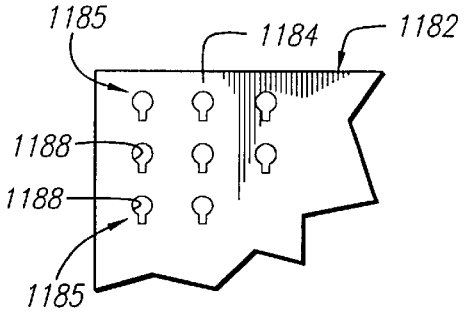
FIG. 3

SELECTION GAME

RELATED APPLICATION

This application is a Continuation-in Part of U.S. application Ser. No. 09/127,997 filed Jul. 31, 1998, now U.S. Pat. No. 5,979,900, issued Nov. 9, 1999, which is a Continuation-in-Part of U.S. application Ser. No. 08/944,079 filed Oct. 4, 1997, now U.S. Pat. No. 5,823,538, issued Oct. 20, 1998, which is a Continuation-in-Part of U.S. application Ser. No. 08/796,713 filed Feb. 6, 1997, now U.S. Pat. No. 5,704,610, issued Jan. 6, 1998.

FIELD OF THE INVENTION

Games where the players select among a plurality of choices, with their selections producing consequences such as a physical action component directed at the players.

BACKGROUND OF INVENTION

Children love competitive action games that involve a degree of suspense and excitement. Often in such games, at some point an action occurs such as a light going on or a siren going off or something falling down. Children also enjoy participating in and causing the action and/or trying to prevent the action. There is further play value in having to react or do something once the action takes place.

SUMMARY OF ILLUSTRATED APPARATUS EMBODYING THE PRESENT INVENTION

In one illustrated form of game apparatus, each player has a selection surface with a plurality of selection locations or sites. At the start of each game, a group of one or more but not all of the sites are predetermined. The players do not know which of the sites on their selection surfaces are the predetermined ones. The players may also each have a target surface with locations or sites that correspond to the locations or sites on the other players selection surface. In one form, the players are instrumental in establishing at the start of each game the positions of targets at sites on their target surfaces, which thereby define the opponent's predetermined selection sites. The players attempt to guess which are the predetermined sites. Their success or failure at correctly selecting the predetermined sites, produces consequences such as directing a liquid discharge at the unsuccessful player. A simple switch arrangement may activate the liquid discharge as well as audio and/or visual effects.

FIG. 2 is an enlarged schematic front view of a portion of a selection surface of the apparatus of FIG. 1.

FIG. 2A is a sectional view taken generally along line A—A of FIG. 2.

FIG. 2B is a sectional view taken generally along line B—B of FIG. 2.

FIG. 3 is an enlarged schematic front view of a portion of a target surface of the game apparatus of FIG. 1.

FIG. 4 is a schematic enlarged sectional view taken through one of the panels of FIG. 1.

FIG. 5 is an enlarged schematic view of a portion of the flexible, resilient shield component of the panel construction of the apparatus of FIG. 1.

FIG. 6 is an enlarged side view of a target piece of the apparatus of FIG. 1.

EMBODIMENTS OF FIGS. 1–12

General Description

Figure 1:
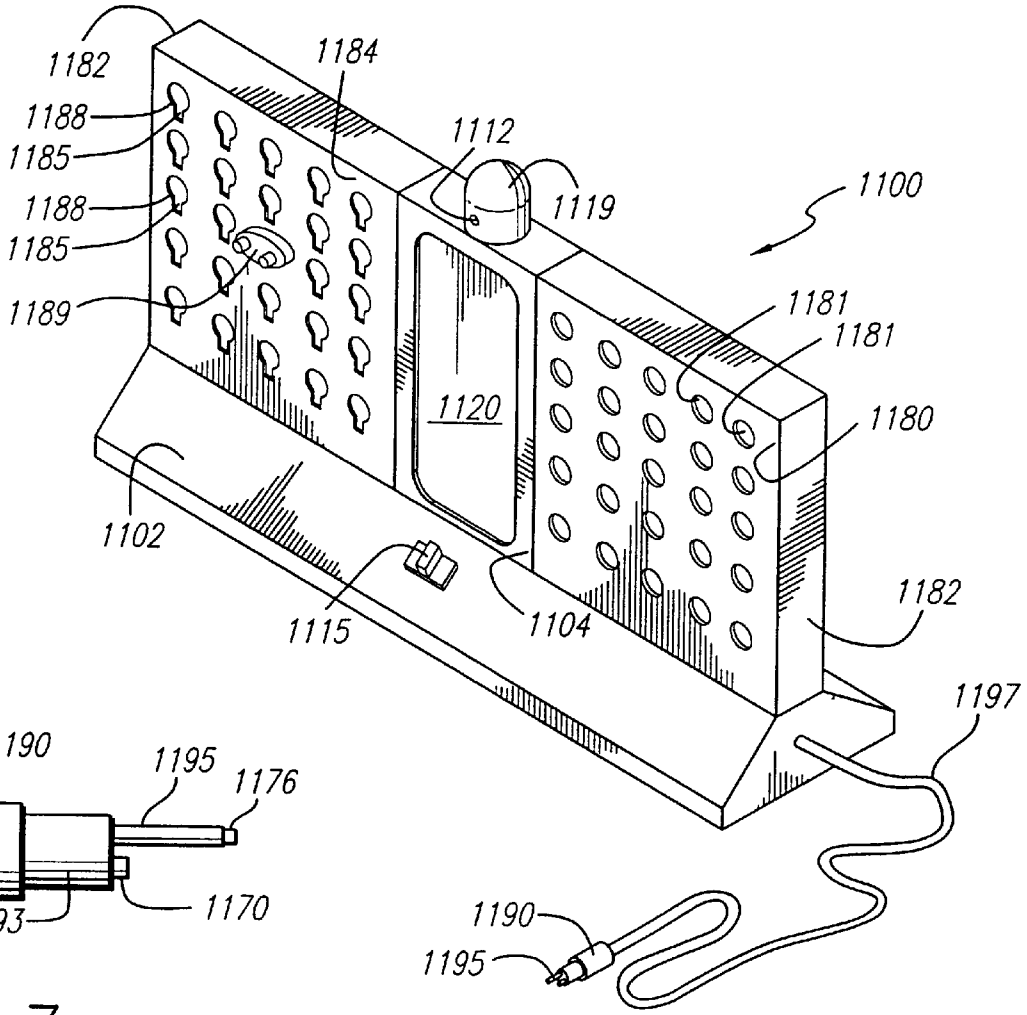
FIG. 1 is a perspective view of one preferred embodiment of the invention involving multi-site selection surfaces.

FIGS. 1–10 disclose another preferred embodiment of the present invention.

In broad terms this apparatus comprises a liquid discharge mechanism in combination with a player selection means for each player that has a plurality of individual selection sites or locations. A group of some but not all of the sites at each selection surface is predesignated at the start of each game, but the players do not know which sites have been predesignated at their selection surfaces. The players may take turns selecting sites in accordance with a game objective, and, dependent upon whether a predesignated site is selected, various effects may occur such as the liquid discharge mechanism being actuated to discharge liquid at one of the players.

Illustrated game apparatus 1100 has selection means for each player in the form of a generally upright selection surface 1180 with a plurality of individual selection sites or locations 1181. The illustrated section surfaces 1180 are each provided by a generally upright panel 1182. In illustrated apparatus 1100 there are two panels 1182, each one providing a selection surface 1180 for one of the two players. The selection surfaces 1180 face in opposite directions, each selection surface being directed at a player area in front of it where the associated player will position herself to observe the selection surface. Each illustrated panel 1182 also provides a generally upright target surface 1184 opposite and aligned with the selection surface 1180 on that panel. Each target surface 1184 has a plurality of individual sites or locations 1185 that are aligned with and correspond to the sites 1181 on the associated selection surface 1180. Thus each player has an associated selection surface 1180 and an associated target surface 1184.

At the start of each game, the players may manually position one or more targets 1186 at whatever locations or sites 1185 on their target surface 1184 that they desire. Thus, the location of the opponent's targets 1186 would be different and unknown to the players at the start of each game.

The players may then take turns selecting sites or locations 1181 on their selection surface 1180 in an effort to "hit" one of the opponents targets 1186 that is on an aligned associated target site 1185. When a selection site or location is selected that is in fact in alignment with a target of the opponent, a liquid discharge mechanism 1119 may be actuated to discharge liquid at the opponent player positioned at their player area. Further, an auditory and/or visual effect may also be provided to signify the "hit". Alternatively, the liquid discharge mechanism might face the player making the selections, and it could be actuated every time that player makes a selection that is not a "hit". As yet another alternative, the liquid discharge mechanism could spray the opponent player when there is a "hit" and the selecting player when there is not a "hit".

In the illustrated game apparatus 1100 the targets 1186 may be physically mounted on and extended through the target surface 1185 so they can physically interact with a selection probe 1190 being manipulated by the other selecting player. The illustrated probe 1190 is connected through an electrical cord 1197 to a microprocessor that controls the operation of the liquid discharge mechanism 1119 and audio/visual effect providing means. When a player selects a site 1181, the player extends the illustrated elongated probe 1190 into and through an opening 1183 at that site. If there is a target 1186 at the associated, aligned target site 1185, the probe engages that target. Such engagement operates a "hit" switch 1192 on the probe which causes the microprocessor to initiate the effects associated with a target "hit". This could include causing the discharge mechanism 1119 to discharge liquid at a player (e.g. the player whose target has been "hit"), causing a light to flash and/or causing the sound of an explosion. The illustrated probe 1190 is provided with a second selection switch 1194 which is activated whenever a selection site or location is selected by insertion of the probe, regardless of whether there is an associated aligned target. Actuation of the selection switch 1194 causes the microprocessor to acuate a different "effect" such as providing a light at the opponent's target surface 1184 at the target location 1185 associated with the selected selection site 1181, so that the opponent player is made aware of where the selection was made, whether or not there was a "hit".

The illustrated targets 1186 are releasibly locked in place so that they resist being dislodged from their target surface 1184 when they are engaged by the probe 1190.

The illustrated liquid discharge mechanism 1119 is constructed and disposed so that it may be aimed in either direction at either player, depending on which player is doing a selection and the rules of the game as to who gets a discharge and when.

The illustrated apparatus 1100 includes the single probe 1190 on a cord 1197 which is long enough so that it may be used by either player at their turn to make selections.

Figure 11:
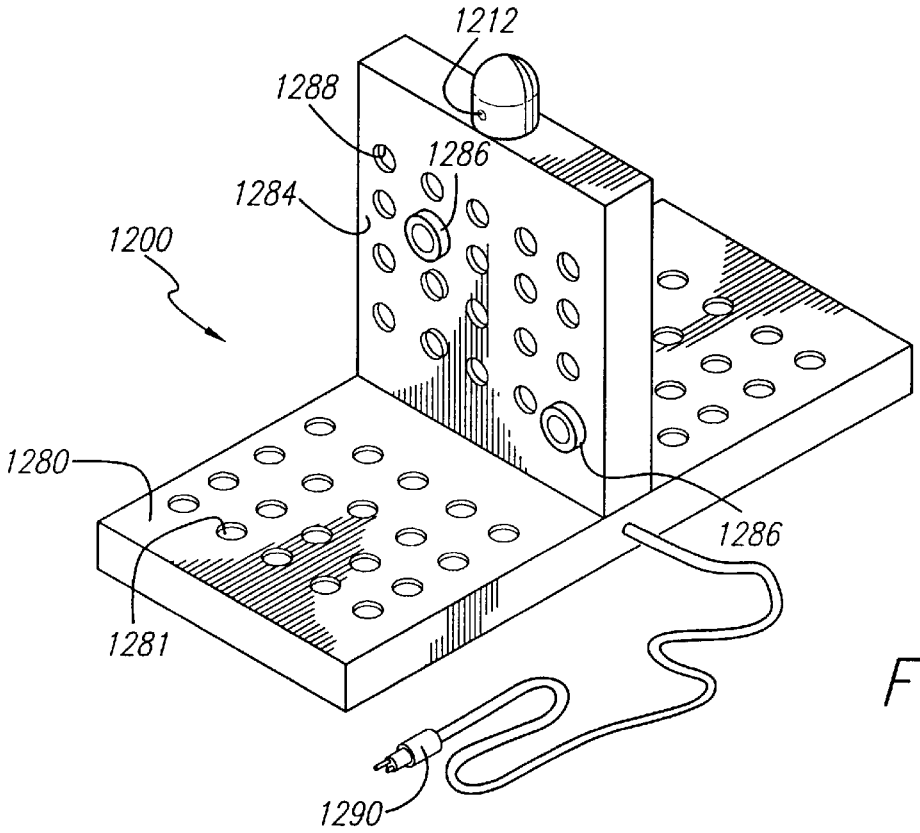
FIG. 11 is a modified form of the game apparatus of FIG. 1.

FIG. 11 illustrates a more sophisticated version of the play apparatus 1200. Each player may be provided with a selection surface 1280 with multiple selection locations or sites 1281.

However, the predetermination at the start of each game of which selection sites 1281 correspond to "hits" may be accomplished on a random or apparently random basis by the microprocessor of that apparatus. Alternatively, the microprocessor could be programmed as to predetermined sites by input from the players.

A player selection of a site 1281 could be done by bringing a probe or the like, or the finger of a player into physical contact or close proximity to the site. Alternatively, selection could be accomplished, when the sites are in a matrix arrangement, by input to a keyboard or the like designating the coordinates of the selected site.

The microprocessor would store information as to predesignated sites and determine when a predesignated site was "hit" by a selection. It would then acuate the liquid discharge mechanism, and/or the audio/visual effect producing means.

Another form of apparatus 1300 is designed for use by a single player to play against a microprocessor. Apparatus 1300 has a single selection surface, and no target surface. At the start of each game, the microprocessor would designate certain sites that would be unknown to the player. A liquid discharge would be directed against the player whenever the selection was not a "hit".

More Detailed Descriptions

Figure 10:
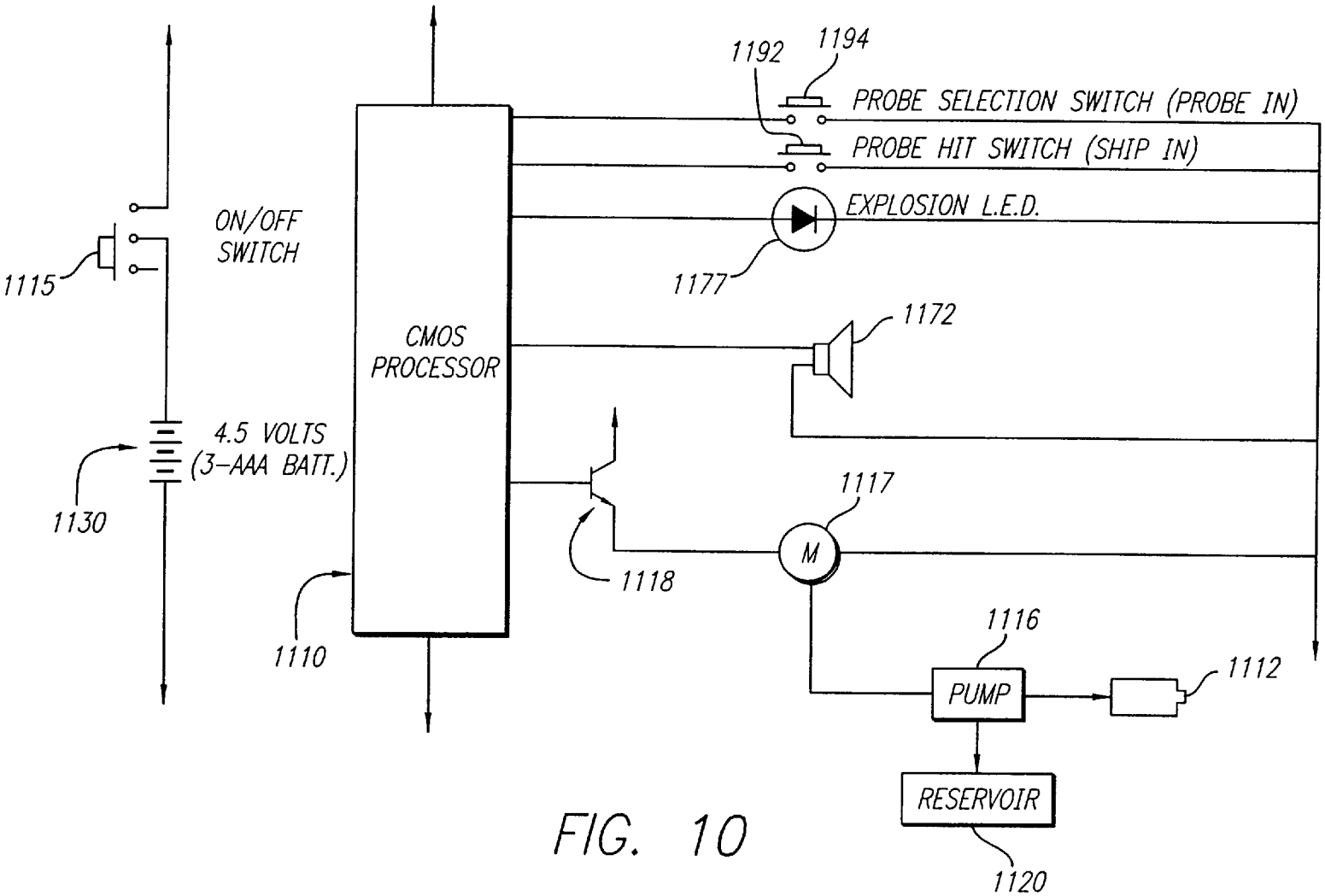
FIG. 10 is a schematic diagram of electrical and other components of the game apparatus of FIG. 1.

The play apparatus 1100 is shown in detail in FIGS. 1–10. A base 1102 supports a center housing section 1104 and at either side of the center section a generally upright panel 1182. Each panel 1182 has a target surface 1184 on one side and a selection surface 1180 on the other opposite side. When assembled on the base 1102, the panels 1182 face in opposite directions so that at each player side there is one target surface 1184 and one selection surface 1180. Mounted in the housing section 1104 between the panels is the liquid discharge mechanism 1119. The mechanism 1119 includes a refillable liquid reservoir 1120 and a liquid discharge nozzle 1112 for directing a liquid discharge or spray at a player area. The nozzle 1112 is rotatably mounted atop the central housing section 1104. As represented in FIG. 10, the mechanism 1119 also includes a pump 1116 which is driven by a motor 1117 to deliver liquid from the reservoir 1120 and out through the nozzle 1112 at the desired time. The motor 1117 may be powered by suitable batteries 1130 and a power transistor 1118 mounted in the housing section 1104, or through an electrical cord (not shown) that can be plugged into a wall outlet. An on-off switch 1115 is mounted on the base 1102 to selectively disconnect the source of power when the apparatus is not in use.

Each of the illustrated panels 1182 is generally square and has a matrix. The illustrated selection surface 1180 has thirty (30) selection sites or locations arranged in a matrix of 6 across×5 down.

Referring to FIGS. 2, 2A, 2B and 4, each selection surface 1180 is provided by the outside surface of a selection wall 1150 of a panel 1182. Each selection site 1181 has a circular opening 1183 and a short inwardly extending tubular section 1152. As shown in the assembly view of FIG. 4, an opaque membrane or sheet 1154 is secured in position generally extending across the full selection wall 1150 and thus over the inner ends of all of the selection site tubular sections 1152. This membrane 1154 serves to prevent the player at the selection surface 1180 from seeing through an opening 1183 and its tubular section 1152 to see if a target 1186 is positioned in alignment with that selection site. The membrane 1154 may be held in place by any suitable means such as a backing plate 1156. The illustrated membrane 1154 is a sheet of flexible, resilient material such as latex and it has an X-shaped slit or cut 1155 aligned with each opening 1183 and tubular section 1152. The slits 1155 allow the probe 1190 to extend through and past the membrane 1154, while continuing to block the view through the opening 1183 when the probe is removed. The backing wall 1156 has openings 1157 that each align with one of the cuts 1155 to allow passage of the probe.

At the side of each panel 1182 opposite its selection surface 1180, there is a generally upright target wall 1187 that provides a target surface 1184 at its outer face. As noted above, there is a target site 1185 on each target surface 1184 that is aligned with each selection site 1181 on the associated selection surface 1180. At each target site 1185, there is a generally keyhole shaped target opening 1188. The target openings 1188 extend through the associated target surface 1184 and target wall 1187. Each illustrated target opening 1188 has an enlarged upper entry portion and a smaller or reduced size lower retaining or locking portion.

FIG. 6 shows a small toy replica of a ship 1189 that has three (3) targets 1186 in the form of projections. The ship 1189 may be mounted on the target surface/wall 1184/1187 (as shown in FIG. 1) by inserting the three projections 1186 into the larger upper entry portions of three of the keyhole openings 1188 in the target surface/wall, and then allowing those projections to move downwardly into the narrower or restricted lower portions of the keyhole openings. This locks each target projection 1186 into position so that pressure against its inwardly directed end will not dislodge the projection from the mating keyhole opening 1188.

Figure 8:
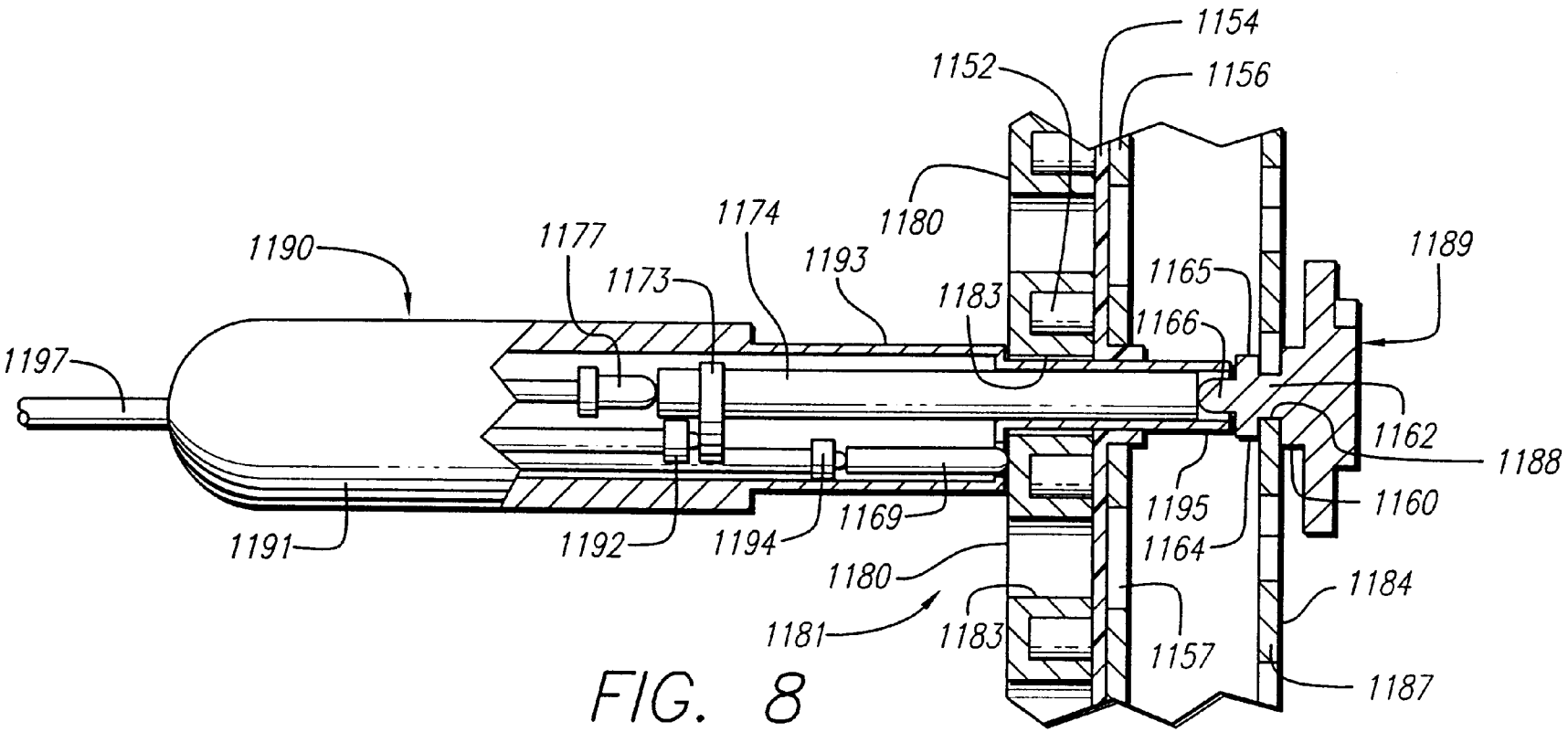
FIG. 8 is an enlarged sectional assembly view showing portions of the probe interacting with portions of the panel structure of the apparatus of FIG. 1.
Figure 9:
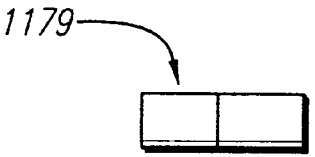
FIG. 9 is a perspective view of a indicator peg of the game apparatus of FIG. 1.

More particularly, as shown in FIGS. 6 and 8, each illustrated projection or target 1186 has an enlarged base portion 1160 located adjacent to the toy ship, a reduced size locking portion 1162 located adjacent to the base portion, another enlarged intermediate locking portion 1164 located adjacent to the reduced size locking portion, and an end contact portion 1166 located adjacent to the enlarged intermediate locking portion. FIG. 8 shows a target/projection 1186 mounted in a target opening 1188. It will be noted that, when so mounted, the enlarged intermediate locking portion 1164 prevents the projection/target 1186 from being pushed out of that opening when it is engaged by the probe 1190.

At the start of each game, each player may mount one or more of the toy ships 1189 on that player's target surface 1184 at locations the player chooses. For the next game, the ships 1189 may be readily removed from one position and moved to another chosen position where different keyhole openings 1188 are occupied.

For selecting selection sites with game apparatus 1100, the selection probe 1190 is provided. As shown best in FIG. 7, the illustrated probe 1190 includes a hand-grippable portion 1191, an intermediate portion 1193 and a forward end portion 1195. The forward end portion 1195 is proportioned to fit into the selection openings 1183 and tubular sections 1152. As noted above, the illustrated screening membrane 1154 has a slit or cut 1155 of X shape or the like aligned with each selection opening 1183 and tubular section 1152 to allow the end portion 1195 of the probe to extend through the membrane and toward the aligned location or site 1185 of the target surface 1184.

Figure 7:
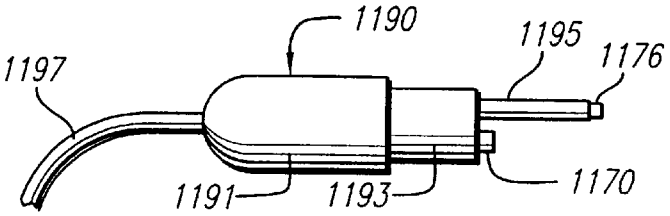
FIG. 7 is an enlarged prospective view of the probe of the apparatus of FIG. 1.

When the probe 1190 is fully inserted into a selection opening 1183 as shown in FIG. 8, a selection switch 1194 is actuated to produce a selection "effect" or signal. More particularly, a longitudinally moveable rod 1169 is supported in the probe intermediate portion 1193 and biased forwardly (by biasing means not shown). The forward end 1170 of the rod 1169 is normally exposed as shown in FIG. 7. When the probe is fully entered into an opening 1183, (FIG. 8), the rod forward end 1170 engages the selection surface 1180, and the rod is moved rearwardly in the probe against the bias means to actuate the selection switch 1194 mounted in the probe. This sends a signal to the microprocessor 1110 that sends a suitable sound to a speaker 1172 (FIG. 10). The sound may be one simulating that of the travel of a shell or missile or the like. At the end of that sound, the microprocessor 1110 lights up a LED 1177.

The LED 1177 is mounted at the rear end of another longitudinally moveable, forwardly biased rod 1174 is supported in the probe 1190. The rod 1174 extends through the probe forward section 1195 and has its forward end 1176 normally exposed (FIG. 7). The rod 1174 is transparent so that light from the LED travels through the rod and can be seen at the rod's forward end 1176. When the probe is inserted into a selection opening 1183,and there is no aligned target, the light from the rod forward end 1176 is visible to the opposing player through the unoccupied aligned target opening 1188. In this way, the opposing player knows that a particular target site or location 1185 has been selected. The opposing player may place an indicator such as colored peg 1179 (FIG. 9) in that opening 1188 to memorialize that selection.

FIG. 8 shows the probe forward end portion 1195 inserted through a selection opening 1183 when there is a target 1186 in the aligned target opening 1188. As noted above, initially the selection switch 1194 is actuated and the microprocessor 1110 first causes the selection sound to be presented through the speaker 1172 and then causes the LED 1177 to be lighted. The illustrated toy ship 1189 and its target/projections 1186 are transparent so that the lighted rod end 1176 is visible through the ship to the opposing player. As the rod forward end 1176 engages the contact end portion 1166 of the aligned target/projection, the rod 1174 is moved rearwardly in the probe to actuate the "hit" switch 1192 mounted in the probe. More particularly, a tab 1173 on the rod 1174 engages and actuates the "hit" switch 1192. Switch 1192 sends a signal to the microprocessor 1110 which initiates operation of the liquid discharge mechanism 1119 at the end of the "missile flight" sound effect. The microprocessor may also initiate another "hit" effect at that time, such as a sound of an explosion through the speaker 1172.

When there is no target 1186 in alignment with a selected site, the rod end 1176 is not depressed and the "hit" switch 1192 is not activated.

In the play of the illustrated apparatus 1100, at the start of each game the players place their targets 1186 at desired locations 1185 on their target surfaces 1184 and actuate the "on" switch 1115. Then the players take turns making selections by inserting the probe 1190 into one of the selection openings 1183 and proceeding in accordance with the rules of the game. At each player's turn, the discharge nozzle 1112 could be rotated to point to the opponent player. For example, the players may alternate single turns, or each player may get a limited of turns or a player may continue until she achieves a first "hit", etc., etc. As noted above, the opposing player may receive a liquid spray or discharge when there is a "hit". Alternatively, the selecting player may receive liquid discharges whenever they fail to make a hit. At each selection the opposing player may memorialize that selection attempt by placing a suitably colored peg 1179 or the like (FIG. 9) in the target opening 1185 where the selection was made. When a "hit" is achieved, the "hit" may be memorialized as by a different color peg 1179*a* that is inserted into a suitable receptacle 1175 in the toy ship 1189 aligned with the target 1186 (see FIG. 6).

The timing of the various effects should be noted. Initially, at each selection, there is the sound of a missile going through the air. Then the light is seen, whether or not there is a "hit". When there is a "hit", the liquid discharge is initiated after the "missile flight" sound. At that time, there may also be an explosion sound.

In another version of the game apparatus 1200 (FIG. 11), each player has a selection surface 1280 with multiple sites 1281 and a target surface 1284 with multiple sites 1288 that are each associated with a selection site. A microprocessor may automatically predetermine at the start of each game the location of targets 1286 associated with selection sites 1281, or may allow a player to establish those target locations by input to the microprocessor. Instead of the mechanical switch arrangement of apparatus 1100, this apparatus 1200 may have selection sites 1281 selected by bringing a suitable probe 1290 or the user's finger into contact or proximity to that site to produce a signal to the microprocessor which will determine whether there has been a "hit" or a "non-hit". The microprocessor will then generate suitable signals to produce "effects" associated with "hits" and with "non-hits", including appropriate activation of the liquid discharge mechanism and/or the sound or sight effects.

Figure 12:
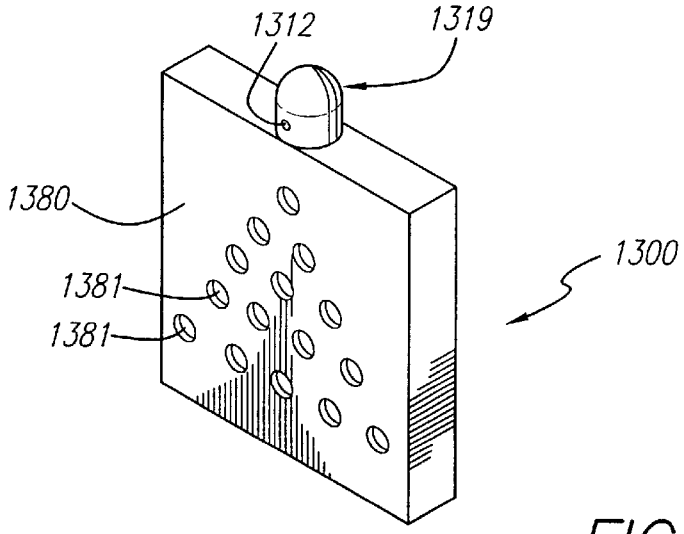
FIG. 12 is another modified form of the game apparatus of FIG. 1.

FIG. 12 illustrates a one-player game apparatus 1300 that has a microprocessor similar to the one in apparatus 1200, but apparatus 1300 has only a single section surface 1380 with multiple selection sites 1381, and there is no target surface. The microprocessor may establish predesignated selection sites at the start of each game, and then respond to the selections made by the single player on the single selection surface 1380. The liquid discharge mechanism 1319 would be actuated when the player fails to make a "hit" rather than against another player when a "hit" is achieved. For example, the player could select sites so as to follow a circuitous path.

Various other modifications and changes may be made in the illustrated structure without departing from the invention as set forth in the following claims.

What is claimed is:

1. A game apparatus comprising:

a) one game board having a selection surface directed to a player area where a player positions herself to observe the selection surface, b) a liquid discharge mechanism selectively operable to direct a liquid discharge, said selection surface having a plurality of selection locations, at least one but not all of said selection locations being predetermined locations, the predetermined locations being different for successive games played with the game apparatus, which of said locations are predetermined being non-discernable to a player at the player area observing the surface, c) a player controlled selection member which, dependent upon whether the selection member selects one of said predetermined locations, actuates the liquid discharge mechanism.

2. The game apparatus of claim 1 designed for two players, said apparatus having a pair of selection surfaces, each of said selection surfaces being directed at a separate player area for one the two players, said discharge mechanism being selectively moveable to point to one of the other said player areas.

3. The game apparatus of claim 2 wherein there are a pair of target surfaces each associated with one of said selection surfaces, each target surface being a plurality of target locations, said target locations of each target surface corresponding to the selection locations of the associated selection surface, each target surface having targets at target locations that each correspond to a predetermined location on the associated selection surface.

4. The game apparatus of claim 3 including means that enable each player to selectively position one or more targets at target locations at the start of each game and thereby determine the predetermined locations on the associated selection surface for that game.

5. The game apparatus of claim 3 wherein said target surfaces and display surfaces are generally upright and aligned with one another so that each location on a display surface is generally aligned and associated with a target location on the associated target surface, each pair of target and display surfaces facing in generally opposite directions toward one of the player areas.

6. The game apparatus of claim 5 wherein targets are selectively mounted on the target surface and each are accessible from the aligned and associated selection location of the associated display surface.

7. The game apparatus of claim 6 wherein each of said selection location has an access opening through said display surface, said player controlled member being a probe that extends through said access opening and engages any target at the associated aligned target location to actuate the discharge mechanism.

8. The game apparatus of claim 7 wherein said target surface includes holders for selectively and removably mounting the target so that said engagement of the target by the probe will not dislodge the target from its holder.

9. The game apparatus of claim 7 wherein a visual barrier normally extends across each access opening to prevent observation of any aligned target, said barrier being openable by said probe when said probe extends through said access opening.

10. The game apparatus of claim 9 wherein said barrier comprises a sheet of flexible, resilient material that has a slit through it at each of said access openings.

11. The game apparatus of claim 7 wherein said probe includes a switch that is actuated by engagement of the probe with a target to actuate the discharge mechanism.

12. The game apparatus of claim 11 wherein said probe has an additional selection switch which is actuated to provide an effect when the probe is inserted into an access opening, whether or not there is in fact any target at that location.

13. The game apparatus of claim 12 where an actuation of said additional selection switch causes a discernable effect that is observable at least by the opposing player, and that at least indicates the location that was selected.

14. The game apparatus of claim 11 where an actuation of said switch causes at least one additional effect.

15. The game apparatus on claim 13 wherein said selection indicating effect generally precedes said actuation of said discharge mechanism.

16. The game apparatus of claim 15 wherein said selection indicating effect comprises the sound of a missile in flight followed by a light at the target location associated with the selected location.

17. A game apparatus comprising:

a) a pair of selection surfaces each having a plurality of selection sites, there being a player area adjacent to each of said selection surfaces where an associated player positions herself to observe the associated surface, b) means for selectively designating for each selection surface at the start of each game a different group of said selection sites as designated sites, said groups being less than all of said selection sites at the associated selection surface, the designated sites at each selection surface not being discernable by the player associated with that selection surface, c) a discharge mechanism actuatable to discharge liquid at at least one of said player areas, and d) means operable by the players to sequentially select selection sites at their respective associated selection surfaces, said means for selectively designating different selection groups of selection sites also interacting with said means to separately select selection sites to cause actuation of said discharge mechanism dependent upon whether a selected selection site is a designated site.

18. The game apparatus of claim 17 wherein said discharge mechanism is selectively moveable to point to the player area of the player not then selecting sites.

19. The game apparatus of claim 18 wherein there is a target surface associated with each of said selection surfaces, each target surface having a plurality of target sites that are each associated with a selection site on the associated selection surface, each target surface having targets at target sites that are associated with designated sites on the associated selection surface.

20. The game apparatus of claim 19 including means that enable each player to selectively position one or more targets at target sites at the start of each game and thereby determine the designate sites on the associated selection surface for that game.

21. A method of playing a game comprising:

a) providing a selection surface directed to a player area where a player positions herself to observe the selection surface, said selection surface having a plurality of selection locations, b) providing a liquid discharge mechanism selectively operable to direct a liquid discharge, c) predesignating at the start of each game at least one but not all of said selection locations as predesignated locations in a manner so that a player at the player area observing the surface will not know which locations are predesignated, d) having the player make a selection among the selection locations, e) actuating the liquid discharge mechanism dependent upon whether the selection is one of said predesignated locations, and f) repeating steps d) and e).

22. The method of claim 21 wherein there are two selection surfaces, each for a different player and each directed to a player area for its associated player.

23. The method of claim 22 wherein at the start of each game, each player predesignates the predesignated locations for the other player.

* * * * *